US008686311B2

(12) United States Patent
Vigouroux et al.

(10) Patent No.: US 8,686,311 B2
(45) Date of Patent: Apr. 1, 2014

(54) BREAKING DEVICE WITH ARC BREAKING SHIELD

(75) Inventors: Didier Vigouroux, Brignoud (FR); Eric Domejean, Voreppe (FR); Yves Belin, Herbeys (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 281 days.

(21) Appl. No.: 13/312,355

(22) Filed: Dec. 6, 2011

(65) Prior Publication Data

US 2012/0152903 A1 Jun. 21, 2012

(30) Foreign Application Priority Data

Dec. 20, 2010 (FR) ..... 10 04970

(51) Int. Cl.
*H01H 33/14* (2006.01)

(52) U.S. Cl.
USPC ..... 218/147; 218/155

(58) Field of Classification Search
USPC ..... 218/147, 155
See application file for complete search history.

(56) References Cited

U.S. PATENT DOCUMENTS

| | | | | |
|---|---|---|---|---|
| 4,459,445 | A * | 7/1984 | Hisatsune et al. | 218/149 |
| 4,464,642 | A * | 8/1984 | Yamagata et al. | 335/201 |
| 4,516,003 | A * | 5/1985 | Yoshiyasu et al. | 218/150 |
| 4,668,926 | A | 5/1987 | Comtois et al. | |
| 4,716,265 | A * | 12/1987 | Fujii et al. | 218/147 |
| 5,337,031 | A * | 8/1994 | Castonguay et al. | 335/201 |
| 5,723,841 | A * | 3/1998 | Kurono | 218/147 |
| 6,624,375 | B2 * | 9/2003 | Leone et al. | 218/155 |
| 7,154,062 | B2 * | 12/2006 | Asakawa et al. | 218/155 |
| 7,586,057 | B2 * | 9/2009 | Sisson et al. | 218/157 |

FOREIGN PATENT DOCUMENTS

| | | |
|---|---|---|
| EP | 0 310 468 | 4/1989 |
| EP | 0 310 469 | 4/1989 |
| FR | 2 577 712 | 8/1986 |
| JP | 2002-075136 | 3/2002 |
| JP | 2005-100762 | 4/2005 |

* cited by examiner

*Primary Examiner* — Truc Nguyen

(74) *Attorney, Agent, or Firm* — Steptoe & Johnson LLP

(57) ABSTRACT

A breaking device with an arc breaking shield comprising at least one stationary contact collaborating with a movable contact supported by a contact-holder arm and an actuating device of the movable contact in a casing.

A movable arc breaking shield is commanded in movement to occupy a rest position and a laminating position. The movable breaking shield is connected to the contact-holder arm by an actuating rod in such a way that movement of the contact-holder arm results in movement of the movable breaking shield, the actuating rod being respectively connected to the movable breaking shield and to the contact-holder arm by a second and third pivot-pin.

12 Claims, 6 Drawing Sheets

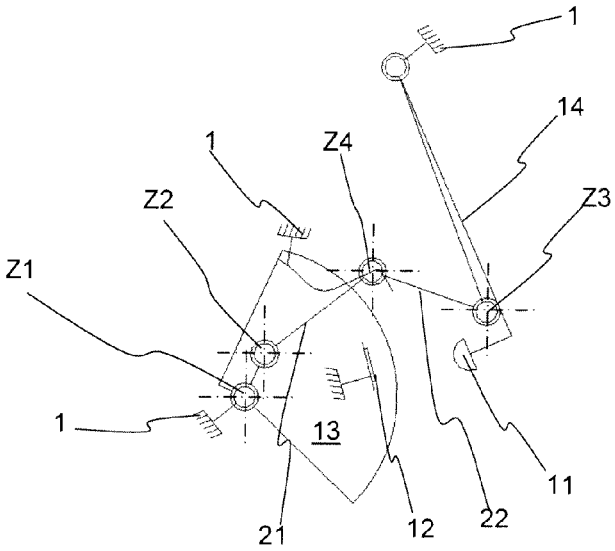
Fig. 5
Fig. 6
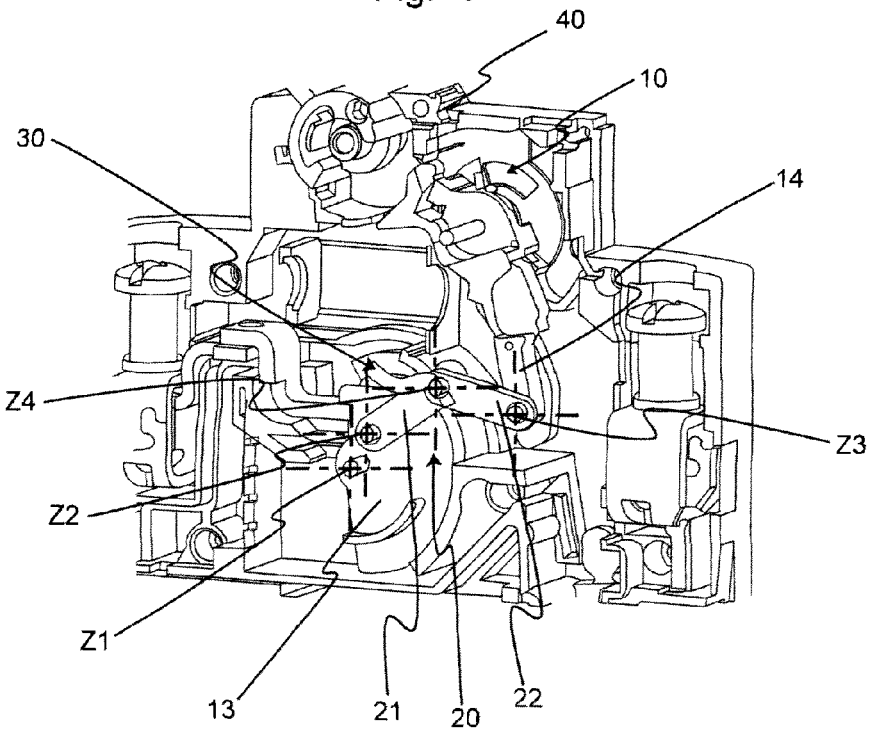

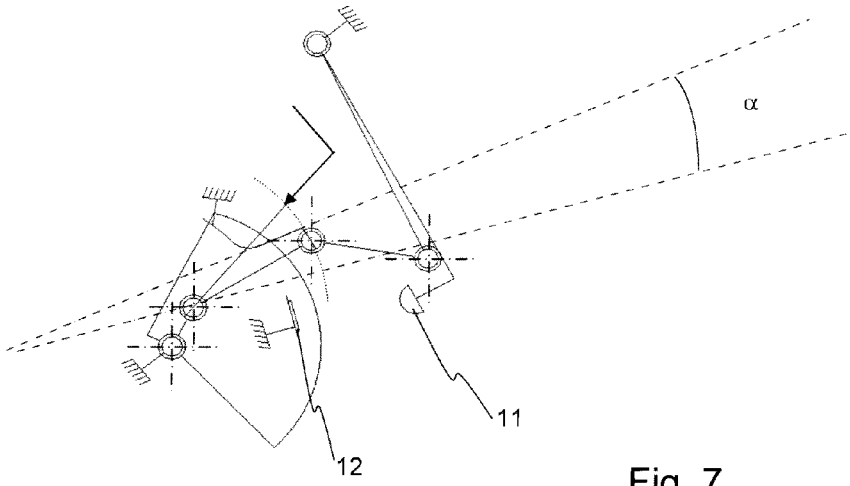
Fig. 7
Fig. 8
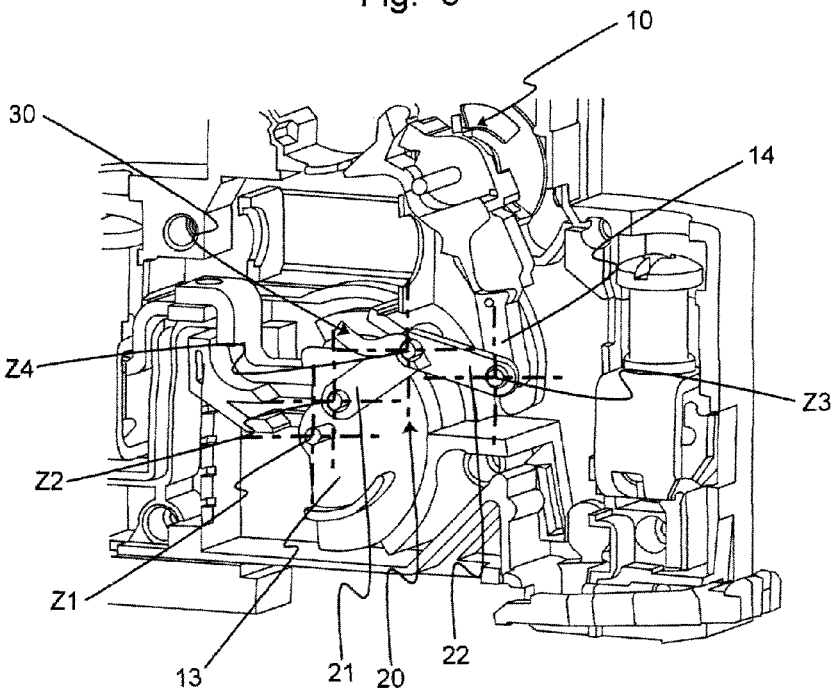

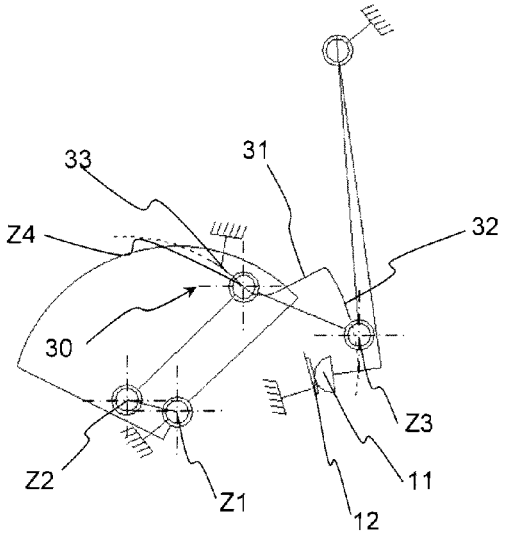
Fig. 9
Fig. 10
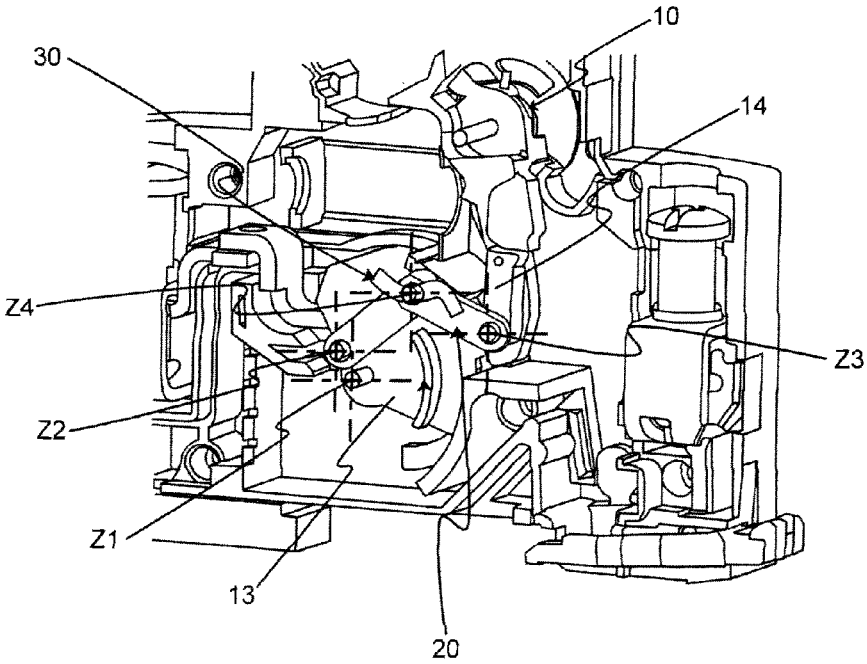

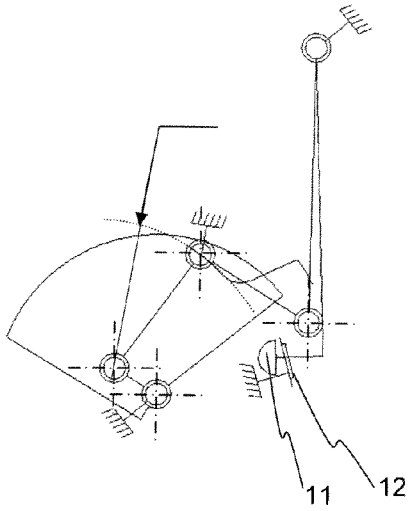
Fig. 11
Fig. 12
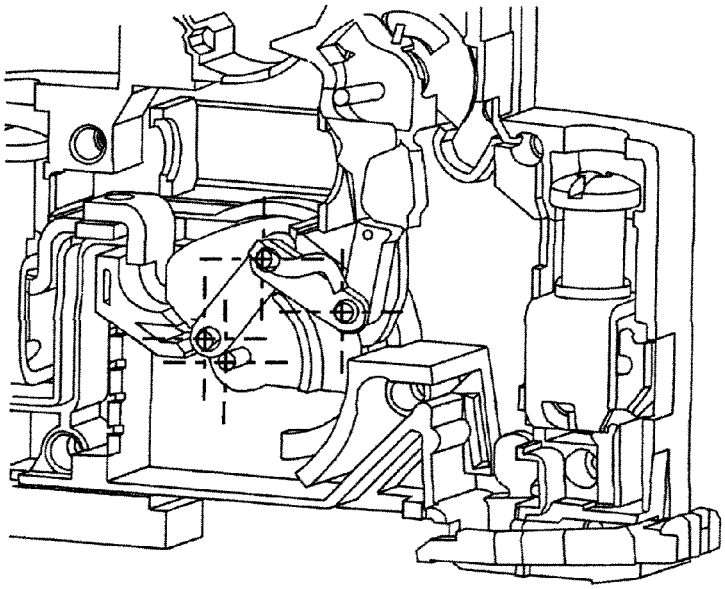

BREAKING DEVICE WITH ARC BREAKING SHIELD

BACKGROUND OF THE INVENTION

The invention relates to a breaking device with an arc breaking shield enabling current breaking to be performed following automatic tripping in case of a short-circuit overcurrent or opening by manual control. Said device comprises at least one stationary contact, in a casing, collaborating with a movable contact supported by a contact-holder arm. Said device comprises an actuating device of the movable contact moving between a closed position and an open position of said contacts. A movable arc breaking shield is commanded in movement to occupy a rest position when the contacts are in the closed position and a laminating position when the contacts are in the open position.

STATE OF THE PRIOR ART

As described in Patent FR2577712, the use of a movable arc breaking shield in a single-pole or multi-pole electric protection switching apparatus is known. This type of apparatus in traditional manner enables breaking of the current following automatic tripping in case of a short-circuit overcurrent or opening by manual control.

The use of such a shield thus enables the electric arc between the contacts to be laminated thereby enabling the electric short-circuit current to be interrupted. Breaking by a shield in fact enables high arcing voltages to be generated whatever the amplitude of the current to be interrupted. For example purposes, the arcing voltage generated can be greater than 500V per pole.

This breaking device is particularly designed for breaking direct current in particular in electric power production installations of photovoltaic type.

Said apparatus further comprises in a casing:

- at least one stationary contact and one movable contact,
- a movable arm supporting the movable contact and elastically biased in the closing direction of the contacts,
- a trip device comprising a trip member and a lock and presenting an operating threshold on a short-circuit overcurrent above which the lock is actuated by the trip member and collaborates with the contact-holder arm to bring about movement of the latter in the opening direction of the contacts.

The movable breaking shield occupies a rest position to which it is biased by a spring and is driven by the trip device in response to a short-circuit overcurrent to interpose itself between the contacts.

The electric protection switch apparatus also comprises a manual control device connected to an operating mechanism collaborating with the contact-holder arm to bring about movement of the arm in the opening direction of the contacts by operation of the control device.

This type of apparatus can be designed to electrically insulate and protect a feeder-motor assembly (contactor, thermal relay) against short-circuits.

It is further known that recourse can be had to the same type of protection switch performing breaking following automatic tripping on a short-circuit to be able to break overload currents, fixed by standards, in response to actuation of a manual control device. Up to now however, in the breaking technique using a shield, in particular in circuit-breaking devices of the type described in the above-mentioned patent, the arc breaking shield is only called on above a short-circuit tripping threshold of the automatic tripping member and therefore only participates in breaking in case of a short-circuit.

To remedy this drawback, the switch apparatus described in patent application EP0310468 enables the same arc breaking shield to be solicited both when automatic tripping takes place on high current surges, i.e. for short-circuit currents, and when opening takes place by manual control at low current intensities, i.e. for overload currents, or even at currents lower than or equal to the rated current intensities.

Known shield operating mechanisms present the drawback of being relatively complex. They in fact generally comprise specific means for manual actuation of said shield and other means able to act on the shield in case of a short-circuit fault. Known mechanisms further sometimes present means for biasing the shield to an operating position.

SUMMARY OF THE INVENTION

The object of the invention is therefore to remedy the shortcomings of the state of the technique so as to propose a breaking device with an arc breaking shield having an optimized operation.

The movable breaking shield of the breaking device according to the invention is connected to the contact-holder arm by an actuating rod in such a way that movement of the contact-holder arm results in movement of the movable breaking shield, the actuating rod being respectively connected to the movable breaking shield and to the contact-holder arm by a second and third pivot-pin.

The movable breaking shield is preferably connected to the contact-holder arm by an actuating rod in such a way that movement of the contact-holder arm from the open position to the closed position results in movement of the movable breaking shield from the laminating position to the rest position, movement of the contact-holder arm from the closed position to the open position resulting in movement of the movable breaking shield from the rest position to the laminating position.

The movable breaking shield is advantageously commanded in rotation around a first pivot-pin securedly affixed to the casing.

According to a preferred embodiment, the actuating rod comprises two sections articulated with respect to one another around a fourth pivot-pin, a first section being connected to the movable breaking shield by the second pivot-pin and a second section being connected to the contact support means by the third pivot-pin.

The fourth pivot-pin preferably comprises at least one end positioned in a guide rail secured to the casing, said guide rail comprising at least a first movement ramp of said fourth pivot-pin to enable simultaneous movement of the contact support means and of the movable breaking shield.

According to a first particular embodiment of the invention, the guide rail comprising at least a second movement ramp of the fourth pivot-pin, movement of said pivot-pin in the second ramp only enables movement of the contact support means beyond the open position of the contacts, the movable breaking shield remaining immobile.

Advantageously, the first and second ramps are abutted in such a way that the second movement ramp is placed at a first end of the first main ramp.

According to a second particular embodiment of the invention, the guide rail comprising at least a third movement ramp of the fourth pivot-pin, movement of said pivot-pin in the third ramp only allows movement of the contact support means beyond the closed position of the contacts, the movable breaking shield remaining immobile.

Advantageously, the first and third ramps are abutted in such a way that the second movement ramp is placed at a second end of the first main ramp.

Advantageously, the second and third movement ramp of the fourth pivot-pin describe an arc of a circle enabling immobilization of the shield and movement of the movable contact, said arc of a circle having the second pivot-pin as its centre.

The first movement ramp preferably comprises a longitudinal pivot-pin forming an angle comprised between 0 and 45° with respect to a pivot-pin joining the second and third pivot-pins.

BRIEF DESCRIPTION OF THE DRAWINGS

Other advantages and features will become more clearly apparent from the following description of particular embodiments of the invention, given for non-restrictive example purposes only and represented in the appended drawings in which:

FIG. 5 represents a view of a kinematic chain of the contact actuating device associated with a movable breaking shield in an open position of the contacts;

FIG. 6 represents a detailed view of the device according to FIGS. 3 and 4 in an open position of the contacts;

FIG. 7 represents a view of a kinematic chain of the contact actuating device associated with a movable breaking shield in an over-travel position on opening of the contacts;

FIG. 8 represents a detailed view of the device according to FIGS. 3 and 4 in an over-travel position on opening of the contacts;

FIG. 9 represents a view of a kinematic chain of the contact actuating device associated with a movable breaking shield in a closed position of the contacts;

FIG. 10 represents a detailed view of the device according to FIG. 3 in a closed position of the contacts;

FIG. 11 represents a view of a kinematic chain of the contact actuating device associated with a movable breaking shield in an over-travel position on closing of the contacts;

FIG. 12 represents a detailed view of the device according to FIG. 3 in an over-travel position on closing of the contacts.

DETAILED DESCRIPTION OF AN EMBODIMENT

Figure 1:
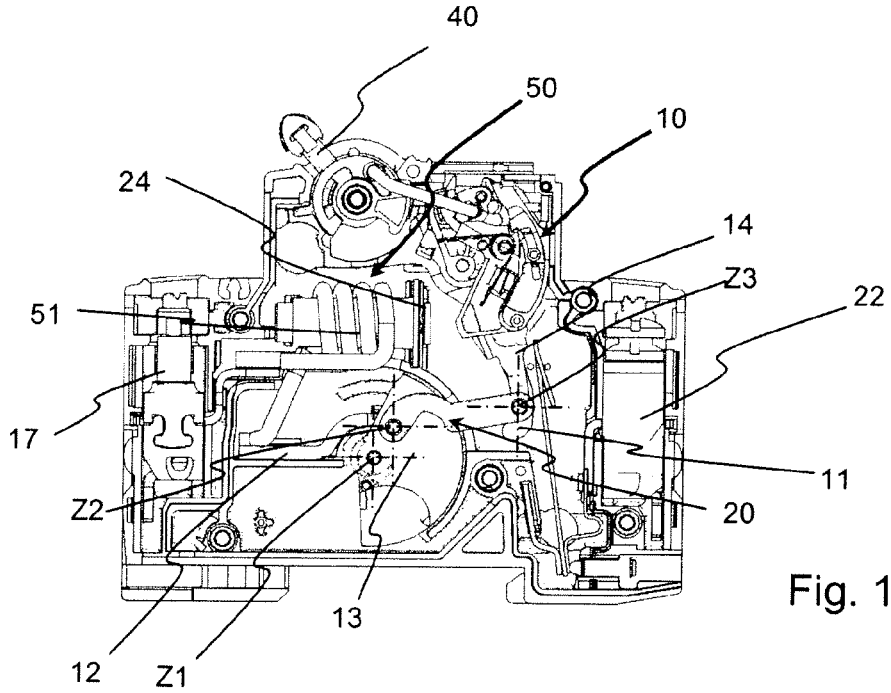
FIGS. 1 and 2 represent perspective views of a breaking device with arc breaking shield respectively in two operating positions according to a first preferred embodiment of the invention.
Figure 2:
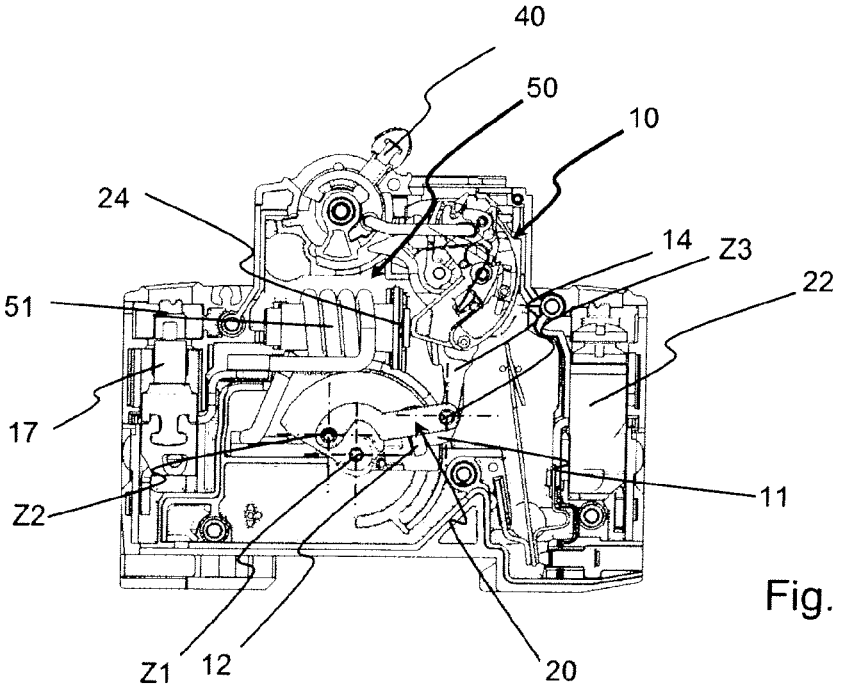

According to an embodiment of the invention as represented in FIG. 1, the breaking device with arc breaking shield comprises a casing 1 in which there are housed at least one stationary contact 12 collaborating with a movable contact 11 supported by a contact-holder arm 14.

The breaking device comprises an actuating device 10 of the movable contact 11 moving between a closed position and an open position of said contacts.

The actuating device 10 can be controlled by means of a manual control device 40. Manual control of opening of the contacts is therefore performed by means of said device operating in conjunction with a contact-holder arm 14 to bring about movement of said arm in the opening direction of the contacts.

The actuating device 10 can also be controlled by means of disconnection means 50 enabling the current to be interrupted following an automatic trip in case of a short-circuit overcurrent. The stationary contact 12 is then electrically connected to one end of a winding of a coil 51 belonging to an electromagnetic trip device of the disconnection means 50. Said winding is itself connected via its other end to an input terminal 17. The electromagnetic trip device further comprises a moving magnetic core 24 in the form of a plunger and mounted in sliding manner inside the coil 51. One end of the core is designed to act directly on the actuating device 10.

The movable contact 11 is arranged at one end of a contact-holder arm 14 and is electrically connected to an output terminal 22. The contact-holder arm 14 is mounted pivoting at its opposite end on the movable contact 11 and is biased in the closing direction of the contacts by a biasing spring that is not shown.

According to an embodiment of the invention, the breaking device comprises a movable breaking shield 13. The shield is commanded in movement to occupy

- a first rest position when the contacts 11, 12 are in the closed position;
- a laminating position when the contacts 11, 12 are in the open position.

The rotating shield 13 normally occupies a rest position to which it is biased by flexible means, in particular a torsion spring, not represented.

According to a preferred embodiment of the invention, the movable rotating breaking shield is preferably a rotating shield connected in integral manner to the casing 1 by means of a first pivot-pin Z1. The movable breaking shield 13 is connected to the contact-holder arm 14 by an actuating rod 20 in such a way that movement of the contact-holder arm 14 results in movement of the movable breaking shield 13.

As represented in FIGS. 1 to 4, the actuating rod 20 comprises two ends respectively connected to the movable breaking shield 13 and to the contact-holder arm 14.

A first end of the rod is connected to the movable shield 13 by a second pivot-pin Z2 and a second end thereof is connected to the contact-holder arm by a third pivot-pin Z3.

The second pivot-pin Z2 is parallel to the first pivot-pin and is eccentric with respect to said first pivot-pin so that movement of the second pivot-pin results in rotation of the movable breaking shield 13.

The movable breaking shield 13 is thus connected to the contact-holder arm 14 by an actuating rod 20 so that movement of the contact-holder arm 14 from the open position to the closed position results in movement of the movable breaking shield 13 from the laminating position to the rest position, movement of the contact-holder arm 14 from the closed position to the open position resulting in movement of the movable breaking shield 13 from the rest position to the laminating position.

Figure 3:
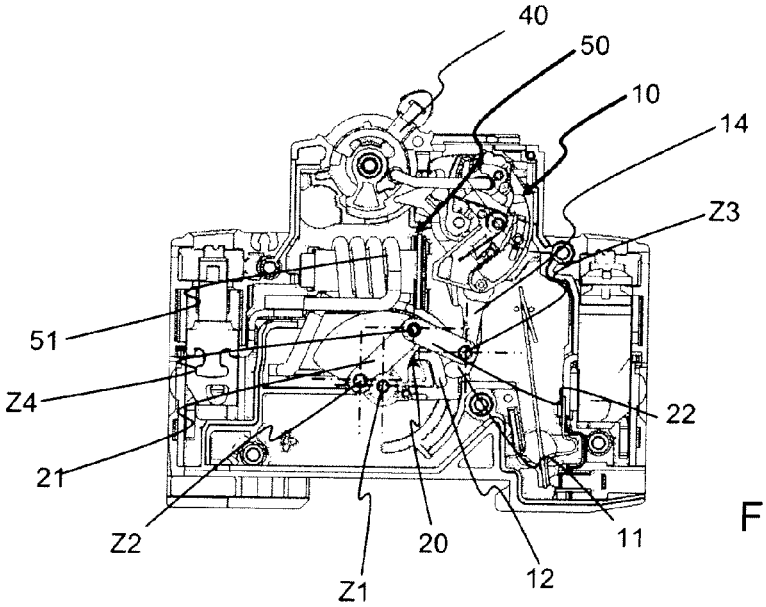
FIGS. 3 and 4 represent perspective views of a breaking device with arc breaking shield respectively in two operating positions according to a second preferred embodiment of the invention.
Figure 4:
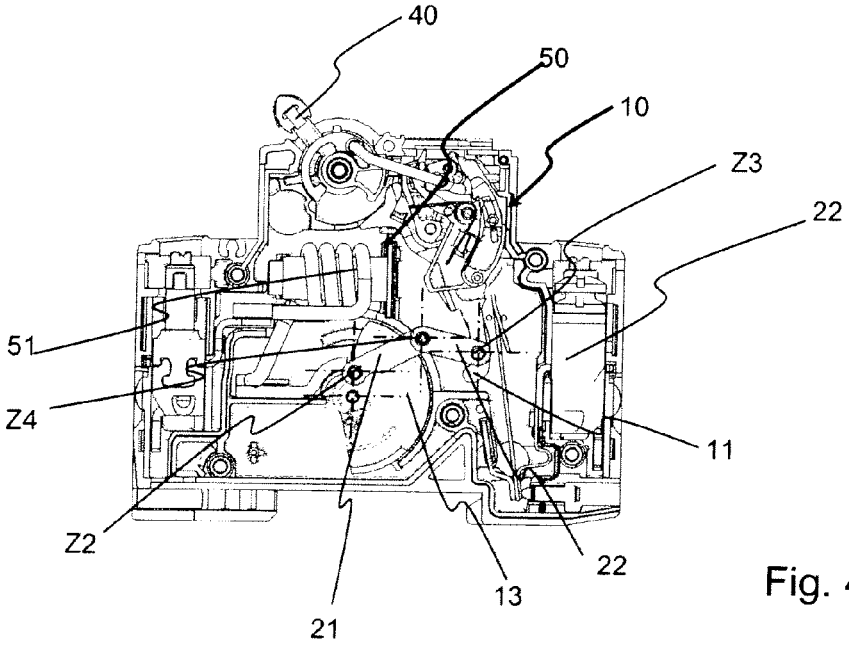

According to a preferred embodiment as represented in FIGS. 3 and 4, the actuating rod 20 comprises two sections articulated with respect to one another around a fourth pivot-pin Z4. The rod then comprises a first section 21 connected to the movable breaking shield 13 by the second pivot-pin Z2 and a second section being connected to the contact support means 14 by the third pivot-pin Z3.

As represented in FIGS. 9 and 10, the fourth pivot-pin Z4 comprises at least one end positioned in a guide rail 30 secured in integral manner to the casing 1.

Said guide rail comprises at least a first main movement ramp 31 of said fourth pivot-pin Z4 to enable simultaneous movement of the contact support means 14 and of the movable breaking shield 13. Movement of the fourth pivot-pin Z4 from one end of the first main ramp 31 to the other end results in movement of the movable breaking shield 13 from the laminating position to the rest position and vice-versa. The incline of this first ramp with respect to the alignment of the second and third pivot-pins enables the acceleration undergone by the movable breaking shield 13 at the time opening of the contacts takes place to be adjusted. At the time opening of the contacts commanded by the disconnection means 50 takes place, the contact support means 14 move and drive the actuating rod 20 in its movement. As an example embodiment, the angle $\alpha$ formed by the first main ramp 31 and the pivot-pin connecting the second and third pivot-pins is comprised between 0 and 45°.

According to a first particular embodiment of the breaking device with a shield as represented in FIGS. 7 and 8, the guide rail 30 comprises at least a second movement ramp 32 of the fourth pivot-pin Z4. The second movement ramp is placed at a first end of the first main ramp 31. The second ramp 32 describes an arc of a circle enabling rotation of the first section 21 of the rod 20 without the shield 13 moving. The centre of the arc of the circle coincides with the second pivot-pin Z2. When the fourth pivot-pin Z4 starts to move in the second movement ramp 32, the movable breaking shield 13 is in the laminating position and is immobile. Movement of the fourth pivot-pin Z4 in the second movement ramp then only enables movement of the contact support means 14 beyond the open position of the contacts.

According to a second particular embodiment of the breaking device with a shield as represented in FIGS. 11 and 12, the guide rail 30 comprises at least a third movement ramp 33 of the fourth pivot-pin Z4. The third movement ramp 33 is placed at a second end of the first main ramp 31. The third ramp 33 describes an arc of a circle enabling rotation of the first section 21 of the rod 20 without the shield 13 moving. The centre of the arc of the circle coincides with the second pivot-pin Z2. When the fourth pivot-pin Z4 starts to move in the third guide ramp 32, the movable breaking shield 13 is in the open position and is immobile. Movement of the fourth pivot-pin Z4 in the third guide ramp 33 then only enables movement of the contact support means 14 beyond the closed position of the contacts. This second particular embodiment is particularly suitable when the contacts are worn and the contact support means 14 has a larger movement travel than that observed when the contacts are not worn.

According to these particular embodiments of the invention, the shape of the guide rail is substantially an S-shape.

Thus, by use of this guide rail comprising one or more movement ramps, use of the actuating rod 20 enables the angular travel of the shield to be amplified from a limited movement of the contact-holder. This embodiment also enables insertion of the shield between the contacts to be accelerated.

The breaking device according to the invention is preferably a single-pole breaking device. Thus, unlike existing solutions, the originality of the new design is also based on the fact that the mechanism enables easy assembly of the two-pole product from the single-pole product.

In the case of a two-pole, three-pole or four-pole breaking device, if a movable contact opens subsequent to a repulsion phenomenon, the shield connected to this movable contact can move and insert itself very quickly between the contacts without waiting for the other poles to open.

According to an alternative embodiment, the actuating device 10 can also be controlled by means of a thermal trip device. The thermal trip device preferably comprises a bimetal strip connected between the movable contact 11 and the output terminal 22.

The invention claimed is:

1. A breaking device with an arc breaking shield enabling current breaking to be performed following automatic tripping in case of a short-circuit over-current or opening by manual control, comprising in a casing:

at least one stationary contact collaborating with a movable contact supported by a contact-holder arm, an actuating device of the movable contact moving between a closed position and an open position of said contacts;

a movable arc breaking shield commanded in movement to occupy a rest position when the contacts are in the closed position;

a laminating position when the contacts are in the open position;

wherein the movable breaking shield is connected to the contact-holder arm by an actuating rod in such a way that movement of the contact-holder arm results in movement of the movable breaking shield, the actuating rod being respectively connected to the movable breaking shield and to the contact-holder arm by a second and third pivot-pin.

2. The breaking device according to claim 1, wherein the movable breaking shield is connected to the contact-holder arm by an actuating rod in such a way that movement of the contact-holder arm from the open position to the closed position results in movement of the movable breaking shield from the laminating position to the rest position, movement of the contact-holder arm from the closed position to the open position resulting in movement of the movable breaking shield from the rest position to the laminating position.

3. The breaking device according to claim 1, wherein the movable breaking shield is commanded in rotation around a first pivot-pin integral to the casing.

4. The breaking device according to claim 1, wherein the actuating rod comprises two sections articulated with respect to one another around a fourth pivot-pin, a first section being connected to the movable breaking shield by the second pivot-pin and a second section being connected to the contact support means by the third pivot-pin.

5. The breaking device according to claim 4, wherein the fourth pivot-pin comprises at least one end positioned in a guide rail integral to the casing, said guide rail comprising at least a first movement ramp of said fourth pivot-pin to enable simultaneous movement of the contact support means and of the movable breaking shield.

6. The breaking device according to claim 5, wherein the guide rail comprising at least a second movement ramp of the fourth pivot-pin, movement of said pivot-pin in the second ramp only enables movement of the contact support means beyond the open position of the contacts, the movable breaking shield remaining immobile.

7. The breaking device according to claim 6, wherein the second ramp describes an arc of a circle enabling rotation of the first section of the rod without the shield moving, said arc of a circle comprising a centre coinciding with the second pivot-pin.

8. The breaking device according to claim 6, wherein the first and second ramps are abutted in such a way that the second movement ramp is placed at a first end of the first main ramp.

9. The breaking device according to claim 5, wherein the guide rail comprising at least a third movement ramp of the fourth pivot-pin, movement of said pivot-pin in the third ramp only enables movement of the contact support means beyond the closed position of the contacts, the movable breaking shield remaining immobile.

10. The breaking device according to claim 9, wherein the third ramp describes an arc of a circle enabling rotation of the first section of the rod without the shield moving, said arc of a circle comprising a centre coinciding with the second pivot-pin.

11. The breaking device according to claim 9, wherein the first and third ramps are abutted in such a way that the third movement ramp is placed at a second end of the first main ramp.

12. The breaking device according to claim 5, wherein the first movement ramp comprises a longitudinal pivot-pin forming an angle comprised between 0 and 45° with respect to a pivot-pin joining the second and third pivot-pins.

* * * * *